United States Patent [19]

Nelson

[11] 4,254,784

[45] Mar. 10, 1981

[54] METHOD AND APPARATUS FOR ATTACHING A HAIR UNIT

[75] Inventor: Charles W. Nelson, Kansas City, Mo.

[73] Assignee: Apollo Hair Systems, Inc., Kansas City, Mo.

[21] Appl. No.: 26,783

[22] Filed: Apr. 3, 1979

[51] Int. Cl.[3] ..... A41G 3/00

[52] U.S. Cl. ..... 132/53

[58] Field of Search ..... 132/53, 5, 7, 54, 9; 3/1

[56] References Cited

U.S. PATENT DOCUMENTS

| | | | |
|---|---|---|---|
| 3,605,761 | 9/1971 | Margo | 132/5 |
| 3,871,389 | 3/1975 | Bauer | 132/53 |
| 3,970,092 | 7/1976 | Nelson | 132/5 |
| 4,016,888 | 4/1977 | Smiley | 132/53 |
| 4,050,100 | 9/1977 | Barry | 3/1 |
| 4,092,739 | 6/1978 | Clemens et al. | 3/1 |

*Primary Examiner*—G. E. McNeil

*Attorney, Agent, or Firm*—Schmidt, Johnson, Hovey & Williams

[57] ABSTRACT

An improved hair unit assembly and method is disclosed wherein the user's natural hair is employed to attach the hair unit in place. In practice, one or more elongated, apertured tubes are placed adjacent the user's natural hair, and strands thereof are pulled into the tubes; an elongated, frictional locking member or adhesive is then inserted within each tube to secure the tubes in place. An appropriate hair unit can then be secured to the tubes by any one of a number of techniques. Reinforcing tube segments are also used to interconnect and bridge spaced hair-receiving tube sections to thus rigidify the overall assembly.

18 Claims, 19 Drawing Figures

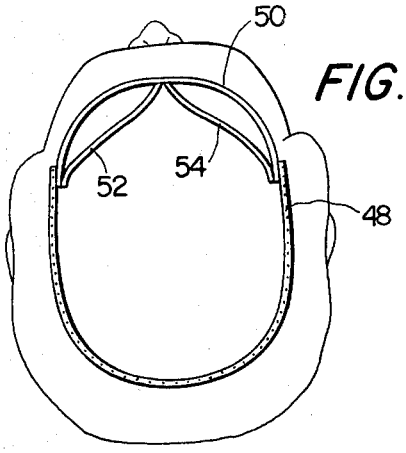
FIG. 14
FIG. 11
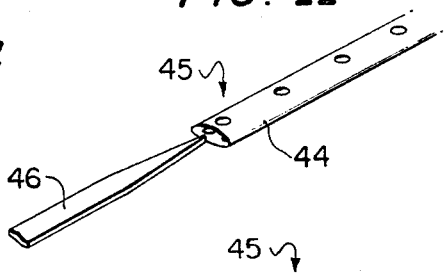
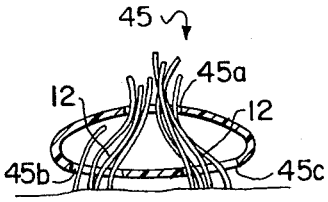
FIG. 12
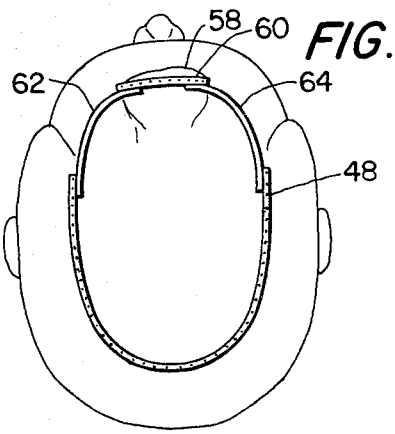
FIG. 16
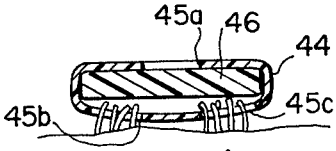
FIG. 13
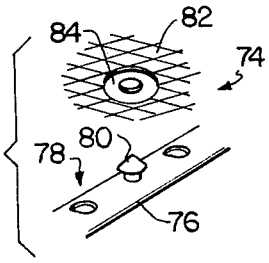
FIG. 19
FIG. 18
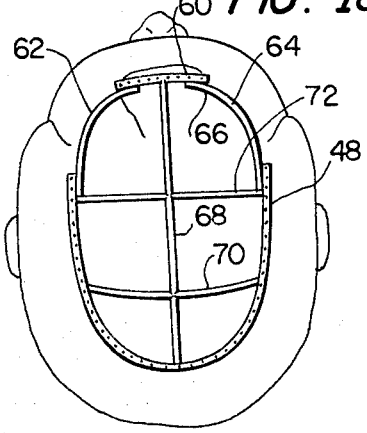
FIG. 15
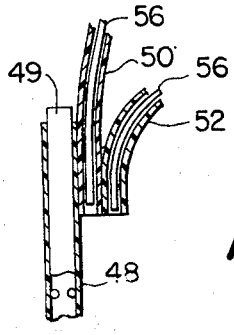
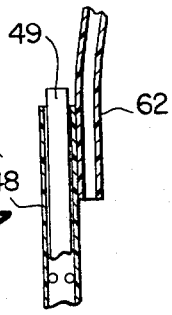
FIG. 17

METHOD AND APPARATUS FOR ATTACHING A HAIR UNIT

BACKGROUND OF THE INVENTION

1. Field of the Invention

The present invention is concerned with a hair unit assembly and method which is applicable to situations wherein the user retains at least some natural hair. More particularly, it is concerned with such an assembly and method wherein elongated, apertured locking tubes are employed to in effect lock the hair unit in place using strands of the natural hair of the recipient.

2. Description of the Prior Art

Previously employed methods of attaching hair units have not been entirely satisfactory inasmuch as they required the use of various hair unit attaching devices for properly securing the hair unit to the head of the recipient. These devices generally would take the form of some mechanical contrivance that would be either uncomfortable, unreliable, difficult to secure, or possibly even unsightly and therefore less than desirable for one reason or another.

U.S. Pat. No. 3,970,092 describes a method of attaching a hair unit wherein use is made of the natural hair of the recipient. The method of this patent involved pulling strands of the user's natural hair through the open-netting base of the hair unit, followed by knotting of the natural hair strands. Other patents of background interest in this connection include U.S. Pat. Nos. 3,444,865 and 3,695,278.

SUMMARY OF THE INVENTION

The present invention provides an improved overall hair unit assembly, and a corresponding method, wherein use is made of strands of the user's natural hair, but without the necessity of knotting the same. In general, the hair unit assembly of the invention comprises a hair unit including a base element, and a plurality of natural hair-simulated strands secured to the base element, along with means for attaching the hair unit to the recipient's head. The attaching means preferably includes at least one elongated tube configured to present a series of apertures along the length thereof, which allow strands of the natural hair of the user to be inserted within the tube, and locking means in the form of a quantity of known medical adhesive, or an elongated locking member disposed within the tube in tight engagement with the internal tube wall and the strands of natural hair therewithin. Of course, a combination of a locking member and adhesive may also be used. Finally, structure is provided for connecting the hair unit to the tube.

In further preferred forms of the invention, the tube is configured to present respective sets of openings along the length of the tube, with at least certain of the openings of each respective set being generally opposed. In this fashion a hook-type instrument can be inserted through the opposed holes to hook strands of the user's natural hair and pull such strands upwardly into the tube itself. The locking member or members inserted within the hair-receiving tube or tubes can advantageously be a simple wire and fiber pipe cleaner, or a synthetic resin insert, usable with or without adhesive.

The hair unit (which normally has a base of open-netting configuration) can either be tied to the hair-receiving tubes or mechanically interlocked therewith. In other embodiments a base formed of a skin-simulating synthetic resin material such as a polyurethane or a silicone can be used.

Tubular reinforcing segments, preferably containing a central, shape-retaining wire, can be bonded to the hair-receiving tubes for bridging and interconnecting spaced portions thereof. In this manner the overall hair unit assembly is rigidified and reinforced.

BRIEF DESCRIPTION OF THE DRAWINGS

FIG. 11 is a fragmentary perspective view illustrating another type of apertured, hair-receiving tube in accordance with the invention, along with a synthetic resin locking member;

FIG. 12 is an enlarged sectional view similar to that of FIG. 5 which illustrates the user's natural hair strands drawn upwardly through and partially out of the hair-receiving tube depicted in FIG. 11;

FIG. 13 is an enlarged sectional view similar to FIG. 7 which illustrates the embodiment of FIGS. 11–12 in its completed condition;

FIG. 14 is a plan view of another embodiment of the invention wherein a single, arcuate, hair-receiving tube is employed, along with forwardly extending reinforcing tube segments;

FIG. 15 is a greatly enlarged, fragmentary sectional view illustrating the interconnection between the hair-receiving tube and the reinforcing segments;

FIG. 16 is a plan view of yet another embodiment of the invention wherein a pair of apertured, hair-receiving tubes are employed over respective, spaced portions of the user's natural hair, with corresponding resilient reinforcing tubular segments serving to interconnect the spaced hair-receiving tubes;

FIG. 17 is a greatly enlarged sectional view similar to that of FIG. 15 which illustrates the interconnection between one of the hair-receiving tubes and corresponding reinforcing segment;

FIG. 18 is another embodiment of the invention similar to that of FIG. 16, but including a lattice of reinforcing segments for providing support and rigidity to the overall assembly; and FIG. 19 is a view illustrating an apertured, hair-receiving tube in accordance with the invention having an upstanding, conical locking projection thereon, along with an open-netting hair unit base element having therein a corresponding grommet adapted to receive and interlock with the projection on the hair-receiving tube.

DESCRIPTION OF THE PREFERRED EMBODIMENTS

Figure 1:
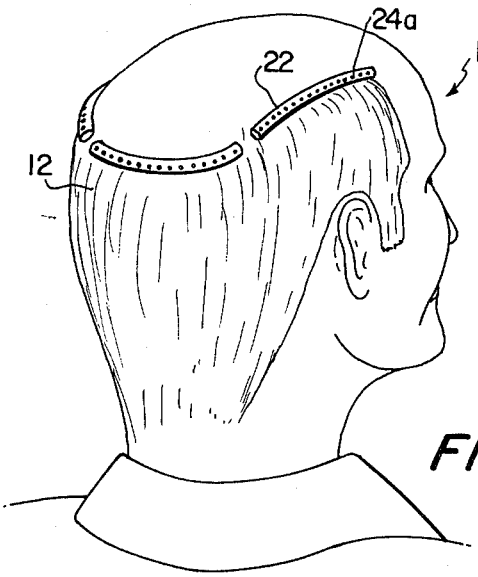
FIG. 1 is a perspective view of a partially bald man, showing a plurality of hair-receiving tubes of the present invention secured about the periphery of the man's remaining natural hair.
Figure 2:
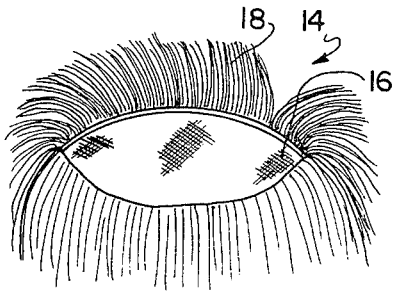
FIG. 2 is a rear view similar to that of FIG. 1, but showing a hair unit in place and with certain of the hair-simulating strands removed to depict the underlying open-netting base of the hair unit itself.
Figure 3:
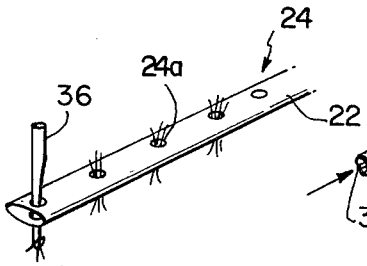
FIG. 3 is an enlarged, fragmentary, perspective view illustrating one of the hair-receiving tubes of the invention, with strands of hair pulled upwardly therethrough and at least partially received within the tube.

Turning now to the drawings, FIG. 1 illustrates a man 10 who is partially bald but has retained at least some natural hair 12, principally about the sides of the head. The present invention is primarily concerned with a hair unit assembly and corresponding method for such an individual.

Broadly speaking, a hair unit assembly in accordance with the present invention includes a hair unit 14 having an open-netting (or skin-simulating synthetic resin) base element 16 and a plurality of natural hair-simulating strands 18 secured to the base element. Means generally referred to by the numeral 20 is provided for attaching hair unit 14 to the recipient's head, and particularly to the natural hair 12 thereon. Attachment means 20 includes at least one elongated tube 22 of synthetic resin material which is configured to present a series of spaced apertures 24 along the length thereof for allowing strands of the natural hair 12 to be inserted at least partially within the tube 22. Means 20 further includes locking means such as medical adhesive and/or an elongated locking member 26 designed to be inserted within the tube 22 in tight engagement with the inner wall surfaces of the latter and the strands of natural hair therewithin, in order to secure the tube 22 to the recipient's head.

Finally, structure broadly referred to by the numeral 28 is provided for connecting the hair unit 14 to the tube or tubes 22.

Figure 4:
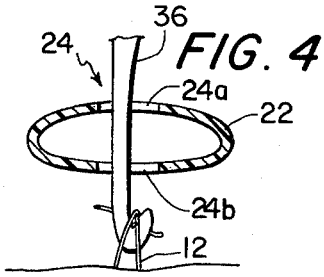
FIG. 4 is a greatly enlarged view illustrating the operation of pulling strands of the user's natural hair upwardly into and through the hair-receiving tube.
Figure 5:
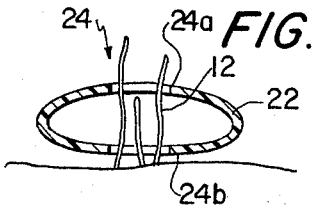
FIG. 5 is a view similar to FIG. 4 but illustrating the orientation of the pulled natural hair strands prior to insertion of a locking member into the hair-receiving tube.
Figure 9:
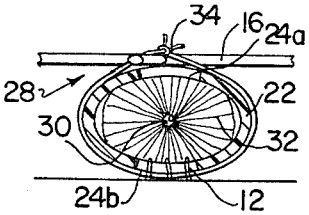
FIG. 9 is an enlarged sectional view which further illustrates the construction depicted in FIG. 8.

Referring first to the embodiment of FIGS. 1–9, it will be seen that the apertures 24 are arranged to present respective sets or pairs thereof, such that an aperture 24*a* and 24*b* is provided in each set, with these apertures being in opposed relationship to one another. As best seen in FIGS. 4 and 5, the tube 22 is arranged such that the apertures 24*b* thereof are adjacent the head of the user.

In the FIGS. 1–9 embodiment, locking member 26 is in the form of a pipe cleaner having a flexible central wire 30 and a large number of outwardly extending fibers 32. As illustrated in FIGS. 6–9, the pipe cleaner locking element is sized to fit within the tube 22 and frictionally engage the inner wall surface of the latter.

Connection structure 28 in this embodiment is in the form of a plurality of spaced ties 34 which extend around the tube 22 and the adjacent portion of the open-netting base element 16 to thus attach the hair unit to the tube 22.

Figure 6:
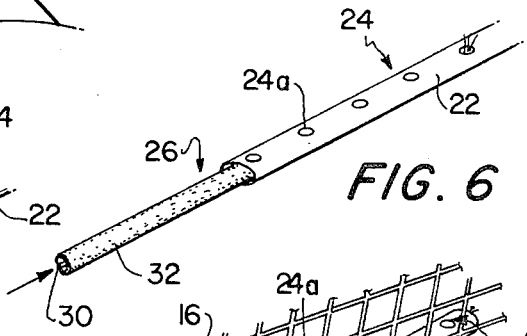
FIG. 6 is a perspective view illustrating the operation of insertion of one type of locking member into the hair-receiving tube.
Figure 8:
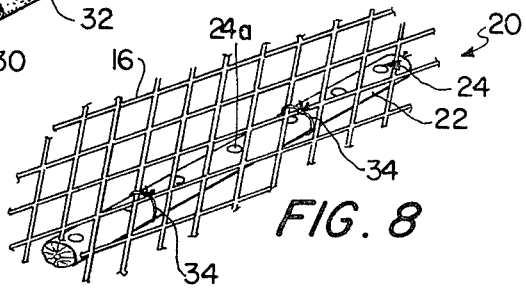
FIG. 8 is a perspective view of the construction illustrated in FIG. 7, but showing the open-netting base of the hair unit in overlying relationship to the tube and secured to the latter by means of spaced ties.

In the use of the invention illustrated in FIGS. 1–9, the following procedure is followed. First, a series of flexible tubes 22 are attached to the head of the recipient, by using the latter's natural hair. This procedure involves successively placing each tube adjacent the recipient's head and proximal to the natural hair 12. This is accomplished through use of a hooked instrument such as a crochet hook 36 which is successively inserted through respective opposed pairs of openings 24*a* and 24*b* (see FIG. 4), whereupon strands of the natural hair 12 are engaged and pulled upwardly into and through the tube. After successive strands of hair have thus been pulled into the tubes 22, the locking member 26 is inserted endwise into the tube, simply by pushing the locking member into the tube as best seen in FIG. 6. The fibers 32 of the locking member 26 thus tightly and frictionally engage the internal wall surface of tube 24, and at the same time lock the strands of hair 12 in place within the tube 22. Thus, each tube 22 is securely attached to the user's head, by employing the natural hair of the user.

At this point the hair unit 14 can be attached to the respective tubes through the use of the ties 34, so as to present a complete hair unit assembly. Of course, the strands 18 of the hair unit 14 will be chosen so as to blend in with the natural hair 12 of the user to give a pleasing overall appearance.

Figure 10:
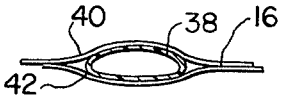
FIG. 10 is an enlarged sectional view illustrating another embodiment of the invention wherein the hair-receiving tube is captively surrounded by respective stretches of an open-netting hair unit base element, such that the tube is permanently secured to the hair unit base.
Figure 7:
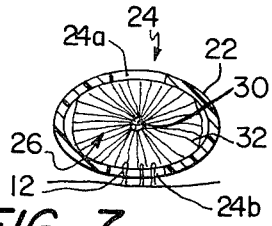
FIG. 7 is a view similar to FIGS. 4 and 5 which shows the locking member operatively inserted within the hair-receiving tube in order to lock the tube in place.

FIG. 10 illustrates a further embodiment of the invention wherein an apertured tube 38 similar to the above-described tubes 22 is permanently attached to the open-netting base element 16 of the hair unit. This is accomplished by placing the tube 38 between respective stretches 40, 42 of the netting material, and securing these stretches together. This embodiment would also employ the skin-simulating material described above, in which event the tube-surrounding stretches of material would be apertured along with the tube itself. A plurality of tubes 38 would normally be so conected to the hair unit. Of course, installation of a hair unit assembly as illustrated in FIG. 10 proceeds exactly as outlined above, except for the fact that the final step of attaching the hair unit is omitted because of the permanent connection between the hair unit and tube or tubes.

Yet another embodiment of the invention is illustrated in FIGs. 11–13. In this instance a tube 44 is provided which is configured to present respective sets of openings 45 spaced along the length thereof. Each set of openings include an upper opening 45*a* and laterally spaced lower openings 45*b* and 45*c*. As best seen in FIG. 12, the opening 42*a* is in general opposition to the lower openings 45*b*, 45*c*. The locking member of the FIGS. 11–13 embodiment comprises a synthetic resin, pointed insert 46 which is rectangular in cross section.

The installation of the FIGS. 11–13 embodiment, proceeds as outline above, wherein the hook 36 is employed to successively extend through the opening pairs 45*a*, 45*b* and 45*a*, 45*c* of each set of openings 45. Here again the strands of hair are pulled upwardly into the tube 44 and will thus be at least partially within the latter and may extend outwardly through the upper opening 45*a*. When the strands of hair have been pulled through the respective sets of openings 45, the locking member or insert 46 is positioned within the tube 44 in the manner as described above, so as to lock the tube 44 to the recipient's head. Of course, a plurality of tubes 44 and elements 46 would normally be employed, and attachment of a hair unit 14 to the tubes 44 would proceed as described previously.

In instances where it is desired to use a medical adhesive as all or a part of the locking means, the adhesive is simply placed or injected into the tubes for holding the latter in place.

In certain instances, it may be desirable to provide reinforcement for the overall hair unit assembly of the invention. Referring first to FIG. 14, it will be seen that an elongated, arcuate, unitary, apertured tube 48 and insert assembly 49 is employed which is identical to the above described tube and insert assembly 44, 46. The tube 48 extends about the head of the recipient and is attached thereto in the manner described. However, in order to provide desired rigidity and support for the hair unit 14, generally forwardly extending reinforcing segments 50, 52 and 54 are provided. Each segment includes an outer secondary tube and an inner, central, reinforcing wire 56 (see FIG. 15). As illustrated, the segment 50 extends around the top of the recipient's head and is bonded to the opposed ends of the tube 48. On the other hand, the segments 52, 54, are respectively bonded to the inner margins of the segment 50, and extend forwardly therefrom and meet at the central area of the segment 50 and are connected at this point.

FIG. 16 illustrates another embodiment of the invention, which is particularly useful when the recipient has natural hair 58 adjacent the top of the head. In this instance, the elongated unitary tube and insert assembly 48, 49 can be employed, along with a somewhat shorter, arcuate, apertured tube and insert assembly 60 which is identical to the assembly 48, 49 but of shorter length. The assembly 60 is connected to the frontal hair 58 in the manner described, whereas the tube 48 is connected to the natural hair extending around the side of the head of the user. The respective assemblies 48, 49 and 60 are in turn interconnected by individual, arcuate reinforcing segments 62, 64. In this embodiment (see FIG. 17), the segments 62, 64 need not include a central reinforcing wire, inasmuch as the assembly 60 is securely connected to the natural hair of the user.

FIG. 18 illustrates a further embodiment which is closely similar to that depicted in FIG. 16. That is to say, the assemblies 48, 49 and 60, as well as reinforcing segments 62, 64 are employed. However, in order to provide even further rigidity and strength, a lattice 66 of reinforcing segments is provided. Specifically, an elongated segment 68 bridges and interconnects the short tube and the central region of the arcuate tube 48; and respective, spaced, transversely extending segments 70, 72 bridge and are interconnected to spaced points on the tube 48, and the segments 70, 72 are interconnected to the segment 68 at the central region where they cross.

FIG. 19 illustrates a connection structure 74 permitting easy removal of the hair unit. Specifically, a tube 76 is provided which has hair-receiving apertures 78 exactly as illustrated and described in connection with the embodiment of FIGS. 11–13. However, the tube 76 is also provided with a plurality of spaced, upstanding, conical locking projections 80. Correspondingly, the open-netting base element 82 of the hair unit is provided with a plurality of flexible annular grommets 84. In the well known fashion, the grommets 84 are adapted to be snapped and locked over the conical locking projections 80, in order to removably hold the hair unit to the tube or tubes 76 forming a part of the overall assembly.

Having thus described the invention, what is claimed as new and desired to be secured by Letters Patent is:

1. A hair unit assembly for attachment to the head of a recipient having at least some natural hair, said assembly comprising;

a hair unit including a base element, and a plurality of natural hair-simulating strands secured to said element; and means for attaching said hairpiece to the recipient's head, including at least one elongated tube configured to present a series of apertures along the length thereof for allowing strands of natural hair to be inserted within the interior of said tube;

locking means disposed within the interior of said tube for securing said tube to said strands of natural hair; and structure for connecting said hair unit to said tube.

2. The hair unit assembly as set forth in claim 1 wherein said tube is configured to present respective sets of openings along the length of the tube, at least certain pairs of the openings of each respective set being generally opposed.

3. The hair unit assembly as set forth in claim 1 including a plurality of said tubes, and a respective locking means within each tube.

4. The hair unit assembly as set forth in claim 1 wherein said base element is in the form of netting.

5. The hair unit assembly as set forth in claim 1 wherein said connection structure includes a plurality of spaced ties for tying said base element to said tube.

6. The hair unit assembly as set forth in claim 1 wherein said connection structure includes a number of upwardly extending locking projections on said tube, and correspondingly a number of grommets in said base element for receiving said projections.

7. The hair unit assembly as set forth in claim 1 wherein said connection structure includes respective sections of said base element for captively surrounding said tube.

8. The hair unit assembly as set forth in claim 1 wherein said locking mean comprises an elongated locking member in tight engagement with the interior of the tube and said strands of natural hair.

9. The hair unit assembly as set forth in claim 8 wherein said locking element includes a flexible central wire and a plurality of fibers extending outwardly therefrom.

10. The hair unit assembly as set forth in claim 1 wherein said locking means includes an adhesive substance.

11. The hair unit assembly as set forth in claim 1 including an elongated reinforcing segment secured to said tube.

12. The hair unit assembly as set forth in claim 11 wherein said segment includes an elongated secondary tube.

13. The hair unit assembly as set forth in claim 12 including an elongated reinforcing wire disposed within said secondary tube.

14. In a method of attaching a hair unit to the head of a recipient having at least some natural hair, said method including the steps of:

placing an elongated, hairpiece-engaging tube having a series of natural hair-receiving openings along the length thereof proximal to the recipient's head and adjacent a portion of said natural hair;

inserting strands of said natural hair into the interior of said tube through said openings; and positioning locking means within the interior of said tube for securing the tube to said strands of natural hair.

15. The method as set forth in claim 14, including the step of attaching to said tube a hair unit having a base element and a plurality of natural hair-simulating strands secured to the base element.

16. The method as set forth in claim 14 wherein a hair unit having a base element and a plurality of natural hair-simulating strands secured to the base element is permanently connected to said tube.

17. The method as set forth in claim 14 wherein said tube is configured to present respective sets of openings along the length of the tube, at least certain pairs of openings of each respective set being generally opposed, said strand-inserting step comprising the steps of passing a hair-engaging hook through said generally opposed pairs of openings in each set thereof, and pulling strands of said recipient's natural hair upwardly through the openings adjacent the recipient's head and into the interior of said tube.

18. The method as set forth in claim 1 wherein said positioning step includes the step of inserting an elongated locking member into said tube in tight engagement with the interior of said tube and said strands of natural hair therewithin.

* * * * *